US008181802B2

(12) United States Patent
Kaushal

(10) Patent No.: US 8,181,802 B2
(45) Date of Patent: May 22, 2012

(54) CLOSURE DEVICE WITH BIASING MEANS

(76) Inventor: Kul Bhushan Kaushal, Leicester (GB)

( * ) Notice: Subject to any disclaimer, the term of this patent is extended or adjusted under 35 U.S.C. 154(b) by 802 days.

(21) Appl. No.: 12/087,143

(22) PCT Filed: Dec. 29, 2006

(86) PCT No.: PCT/GB2006/004950

§ 371 (c)(1),
(2), (4) Date: Jun. 26, 2008

(87) PCT Pub. No.: WO2007/077432

PCT Pub. Date: Jul. 12, 2007

(65) Prior Publication Data

US 2009/0008358 A1 Jan. 8, 2009

(30) Foreign Application Priority Data

Dec. 31, 2005 (GB) ..... 0526638.2

(51) Int. Cl.
*B65D 43/20* (2006.01)
*B65D 41/34* (2006.01)
*B65D 47/28* (2006.01)

(52) U.S. Cl. ..... 215/322; 215/252; 215/388; 220/281; 220/345.1; 220/348; 220/717; 222/518; 222/561

(58) Field of Classification Search ..... 215/388, 215/322; 220/281, 717, 254.1, 254.9, 256.1, 220/259.5, 348, 345.1; 222/561, 570, 511, 222/518

See application file for complete search history.

(56) References Cited

U.S. PATENT DOCUMENTS

| | | | | | |
|---|---|---|---|---|---|
| 1,173,503 | A | | 2/1916 | Goetzke | |
| 1,963,050 | A | | 6/1934 | Graham | |
| 2,127,911 | A | * | 8/1938 | Goss et al. | 222/511 |
| 2,918,200 | A | * | 12/1959 | Libit | 222/512 |
| 2,969,167 | A | | 1/1961 | Libit | |
| 3,731,855 | A | * | 5/1973 | Vos | 222/394 |
| 5,950,881 | A | * | 9/1999 | Sherman et al. | 222/511 |

FOREIGN PATENT DOCUMENTS

WO WO8601700 3/1986

OTHER PUBLICATIONS

International Search Report Aug. 29, 2007.

* cited by examiner

*Primary Examiner* — Robin Hylton
(74) *Attorney, Agent, or Firm* — Ira S. Dorman

(57) ABSTRACT

A closure device includes a base (1) and a top (23). The base (1) has an aperture (13) and the top (23) has an aperture (27). The top (23) is movable laterally relative to the base (1) between a first position in which the aperture (13) of the base and the aperture (27) of the top are not in alignment and a second position in which the apertures are in alignment. Biasing spring (22, 43) is provided with in the top so as to extend laterally between the base and the top with a free end of the biasing spring urging the top towards the first position in which the apertures (13, 27) are not in alignment.

6 Claims, 4 Drawing Sheets

CLOSURE DEVICE WITH BIASING MEANS

This invention relates to a closure device which may be used, for example, in combination with a container for drinks and which may, for example, be operated with one hand It is often desirable to provide a closure device for a container which allows the container to be readily opened and closed. For example, it is often not desirable to consume all the liquid within a drinks container as soon as the container is opened and it is preferable to provide the container with a closure that enables the container to be re-sealed and re-opened as desired. Plastics bottles generally have a screw top which enables the bottles to be re-sealed and re-opened as desired. However, a screw top requires the use of two hands to open and close the bottle and the use of two hands is not always possible or practical, for example when driving a car or riding a bicycle.

It is known to provide plastics bottles with a cap which moves in the axial direction of the bottle to open and close the bottle. However, such caps either require the use of two hands or the use of one hand in conjunction with the user's teeth, which can be undesirable especially when the user wears dentures.

It is therefore an object of the present invention to provide a closure device, for example for a drinks container, which overcomes or at least ameliorates the disadvantages of known closure devices.

According to the present invention there is provided a closure device comprising:

a base having an aperture arranged within a surface of predetermined configuration;

a top having an aperture arranged within a surface of complementary configuration to the surface of the base, the surface of the top being positioned adjacent to the surface of the base so as to inhibit the passage of material between the two surfaces, the arrangement being such that the top is adapted to be movable substantially laterally relative to the base between a first position in which the aperture of the base and the aperture of the top are not in alignment and a second position in which the apertures are in alignment, and biasing means provided within the top so as to extend substantially laterally between the base and the top with a free end of the biasing means urging the top towards the first position in which the apertures are not in alignment.

The base of the device may be provided with first and second screw threaded members for engaging with a threaded container. The first and second screw threaded members may be separable by a frangible connection.

The base of the device may be formed with an outer skirt and an inner ring of lesser depth than the skirt, the skirt and ring being adapted to fit on opposite sides of a container wall.

The base of the device may be provided with a tube extending from the aperture and adapted to extend into a container to which the device is attached.

The top of the device may incorporate an outlet spout extending from the aperture thereof.

The device may include an arrow or the like provided on the top to indicate the direction of movement thereof relative to the base.

The biasing means may be formed integrally with one of the base and the top. Preferably, the biasing means may be integrally formed with the top.

The biasing means may include a plurality of resilient members extending from one of the base and the top towards the other thereof. The biasing means may include two resilient members extending from one of the base and the top towards the other thereof. The other of the base and the top may be formed with an inwardly concave region adapted to receive the free ends of the resilient members. The resilient members may extend substantially radially inwardly from a peripheral region of the base towards the top.

Alternatively, the biasing means may include a resilient member, for example a single resilient member, extending from one of the base and the top towards the other. The biasing means may extend substantially radially outwardly from the base towards the top. The top may be provided with inwardly extending webs to restrict lateral movement of the biasing means. The biasing means may be in the form of a wave, preferably a substantially horizontal wave.

The thickness of the biasing means may decrease towards the free ends thereof so as to increase the flexibility of the biasing means.

The free ends of the biasing means may be rounded.

The biasing means may be accommodated within a region of the top which is raised relative to the remainder thereof. An upstanding web may be provided in part of the remainder of the top, the web extending to substantially the same height as the raised region.

The surfaces of predetermined configuration of the base and the top may be substantially planar. Part of the surface of the base may be raised relative to the remainder thereof. The raised surface may be formed with a recess extending adjacent the periphery thereof. The raised surface may be formed with substantially parallel opposing side edges. The side edges may be formed with outwardly extending protrusions. The top may be formed with portions complementary to the parallel opposing side edges to constrain relative movement between the base and the top. The portions of the top may be formed with outwardly extending protrusions for co-operating with the protrusions of the base so as to maintain the top in position relative to the base.

The device may include a cover mounted around the periphery of the base and adapted to cover the aperture of the top. The cover may include a frangible connection to allow a portion of the cover to be moved relative to the remainder thereof. The portions of the cover may be connected by means of a hinge. The hinge may be connected to the portions of the cover by way of elongate arms. The cover may include a shoulder region adapted to be received on the raised region of the base and on any upstanding web when such is provided.

It should be noted that the closure device of the present invention can be used for containers other than drinks containers. For example, it can be used for other liquids such as vinegar or oil and it can be used for particulate materials such as salt, pepper and sugar.

For a better understanding of the present invention and to show more clearly how it may be carried into effect reference will now be made, by way of example, to the accompanying drawings in which.

Figure 1:
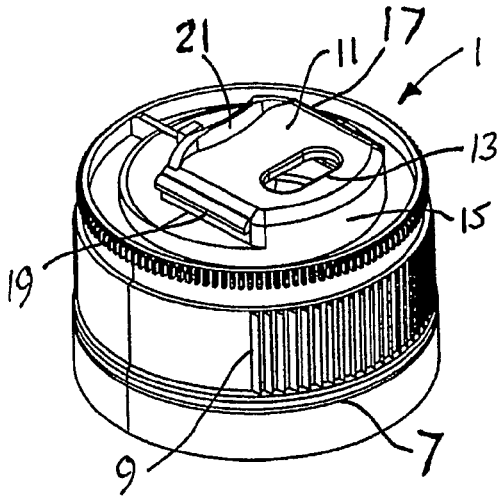
FIG. 1 is a perspective view from above of one embodiment of a base of a closure device according to the present invention.
Figure 2:
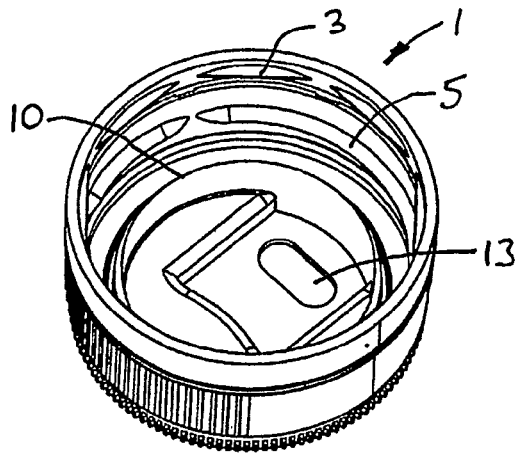
FIG. 2 is a perspective view from below of the base of a closure device shown in FIG. 1.

The closure device shown in FIGS. 1 to 7 includes a base 1 which is of generally cylindrical form and is adapted to be mounted on a bottle or like container by means of a screw thread 3, 5. The base 1 is shown most clearly in FIGS. 1 and 2. The base is ideally made of a plastics material. The screw thread 3, 5 is in two parts separated by a frangible connection 7. The frangible connection 7 enables the base 1 of the closure device according to the present invention to be used as a conventional bottle cap with the upper portion (as shown in FIG. 1) of the base 1 being separated from the lower portion by a relative twisting operation, allowing the upper portion of the base to be removed. The frangible connection 7 also serves as a tamper-evident seal. The twisting operation is facilitated by a serrated region 9 provided on the upper portion of the base 1.

A depending ring 10 is formed a predetermined distance radially within the outer skirt of the base 1. The construction of the closure device inhibits the use of a sealing washer and the depending ring fits closely within the container (not shown in FIGS. 1 and 2) to inhibit the escape of liquid between the container and the base 1.

Provided on a portion of the upper surface (as shown in FIG. 1) of the base 1 is a substantially planar raised surface 11. An outlet aperture 13 is formed in the planar surface and may have any convenient shape, such as the elongate shaped shown in FIGS. 1 and 2.

The raised surface 11 has a curved front edge 15 located relatively close to an outer edge of the base 1, two opposing side edges 17, 19 and a curved rear edge 21 spaced a distance from the outer edge of the base. That is the raised surface 11 is offset from the centre of the base 1 towards an outer edge thereof. The opposing side edges 17, 19 are formed with elongate protrusions extending along the upper (as shown in FIG. 1) portion of each side edge, which protrusions are spaced from the lower portion of each side edge. The rear edge 21 is curved in the same sense as the front edge 15, that is in a concave sense. The rear edge 21 is also formed with an upwardly extending protrusion which also has a concave configuration. If desired, the upper surface of the upwardly extending protrusion may be profiled such that the middle region thereof is higher than the side regions thereof.

The upper edge of the periphery of the base 1 is serrated for reasons that will be explained in more detail hereinafter.

Although not shown in the drawings, the aperture 13 may be adapted to receive a tube, such as a flexible plastics tube, through which liquid may be drawn by the user in the manner of a straw.

Figure 3:
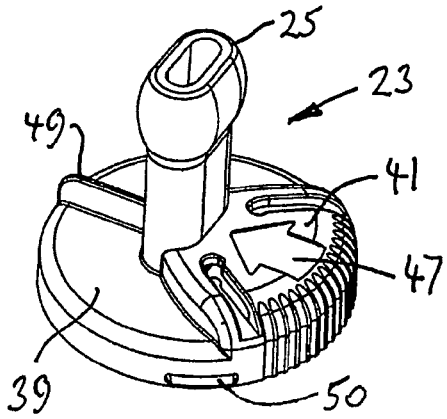
FIG. 3 is a perspective view from above of a top of one embodiment of a closure device according to the present invention.
Figure 4:
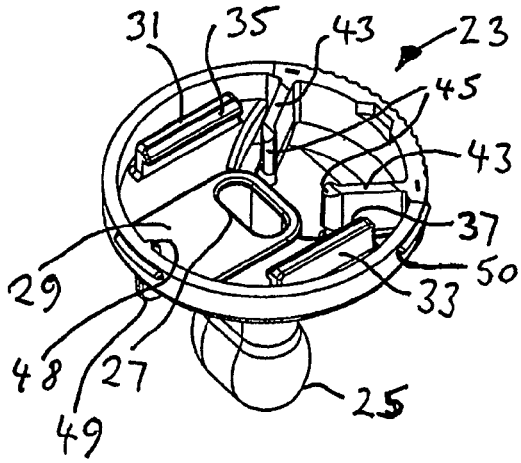
FIG. 4 is a perspective view from below of the top of the closure device shown in FIG. 3.

A top 23 is mounted on the base 1 in a manner which permits lateral sliding to occur between the base and the top. The top 23 is best shown in FIGS. 3 and 4. The top is also ideally made of a plastics material. More specifically, the top 23 is provided with an upwardly extending tubular outlet 25 which communicates with an aperture 27 which is of substantially the same shape as the aperture 13 in the base. The upper region of the tubular outlet 25 may be enlarged if desired. The aperture 27 is provided in a substantially planar surface 29 which is adapted to abut against the planar surface 11 of the base in a manner which substantially prevents the leakage of liquid between the two surfaces and which allows a relative sliding movement between the two surfaces. Sliding motion is controlled by a pair of downwardly extending linear webs 31, 33 which are formed on the facing surfaces thereof with elongate protrusions 35, 37 which extend towards one another. The linear webs 31, 33 extend substantially parallel to the opposing side edges 17, 19 of the base 1, while the protrusions 35, 37 of the top and the protrusions of the base co-operate such that the protrusions of the top are positioned between the protrusions of the base and the lower (as shown in FIG. 1) region of the side edges 17, 19 and such that the protrusions of the base are positioned between the protrusions of the top and an upper surface 39 of the top. In this way the co-operating protrusions allow relative sliding movement between the base and the top, but inhibit removal of the top from the base and thus prevent leakage of the closure device.

A region 41 of the upper surface 39, generally in the form of a sector, is raised relative to the remainder of the upper surface of the top 23 and houses a pair of resilient members 43 which are integrally attached solely at the periphery of the top. The resilient members 43 extend generally radially inwardly towards, but not entirely to, the centre of the top and, because they are attached only at the periphery of the top, are able to flex and to act as springs. The free ends of the resilient members are formed with rounded portions 45 to facilitate sliding movement relative to the rear edge 21 of the raised surface 11 of the base 1 in a manner which will be explained in more detail hereinafter. If desired, the thickness and/or height of the resilient members 43 may decrease towards the free ends thereof so as to vary the degree of resilience along the length of the resilient members. An arrow 47 is provided on the upper surface 39 of the top to indicate the direction of movement of the top relative to the base. A stop 48 serves to limit movement of the top 23 in the opposite direction to the direction of the arrow 47, the stop 48 engaging against the curved front edge 15 of the raised surface of the base 1.

A number of protruding portions 50 extend around the periphery of the top 23, the purpose of which will be described in more detail hereinafter.

Although the resilient members have been described as being integrally attached at the periphery of the top, they may still be made of alternative materials such as stainless steel, suitable plastics material or other food-grade material. Potentially, the resilient members may be replaced by an alternative resilient member, such as a gas-filled chamber or a block of resilient material, such as a resilient foam material.

The apertures 13 and 27 are positioned in their respective planar surfaces in such a manner that they coincide only when the top has been moved in the direction of the arrow 47. In the illustrated embodiment, the aperture 27 of the top 23 is positioned substantially centrally of the base, while the aperture 13 of the base is offset towards the periphery thereof.

An upstanding web 49 is formed on the upper surface of the top on that side of the outlet 25 remote from the raised region 41. The purpose of the upstanding web 49 will be explained in more detail hereinafter.

Figure 5:
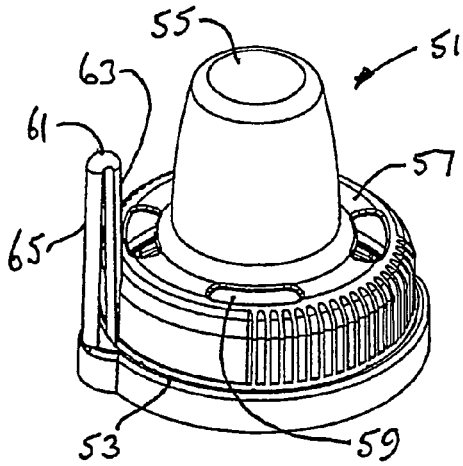
FIG. 5 is a perspective view from above of a cover of one embodiment of a closure device according to the present invention.

A cover 51, also of plastics (ideally transparent or translucent) material is mounted around the periphery of the base 1 by way of the serrations formed around the upper edge of the periphery of the base. The cover 51 is best shown in FIG. 5. The cover 51 is formed as two portions separated by a frangible connection 53. The frangible connection 53 allows the user access to the outlet 25 when the upper part of the cover is removed, but additionally serves as a tamper-evident seal. The upper part of the cover 51 is formed with a domed portion 55 which is joined to the remainder of the upper part by way of a shoulder region 57. A plurality of apertures 59 are formed around the shoulder region 57 to minimise the risk of choking in the unlikely event that a user should swallow the upper part of the cover 51. Once the frangible connection 53 has been broken, the upper part of the cap 51 can be retained on the top 23 by engagement with the peripheral protruding portions 50.

If desired, as shown in FIG. 5, the upper part of the cover 51 may be attached to the remainder thereof by way of a hinge 61. The hinge 61 is joined to the cover 51 by way of arms 63, 65 which are of a sufficient length to allow the top 23 to be moved away from the user's mouth so as to avoid obstructing use of the drink or like container. The upstanding web 49 formed on the upper surface of the top 23 engages against the underside of the shoulder region 57 together with the upper surface of the raised region 41 so as to provide support for the cover 51 in the event that the containers provided with the closure device are stacked on top of each other.

Figure 6:
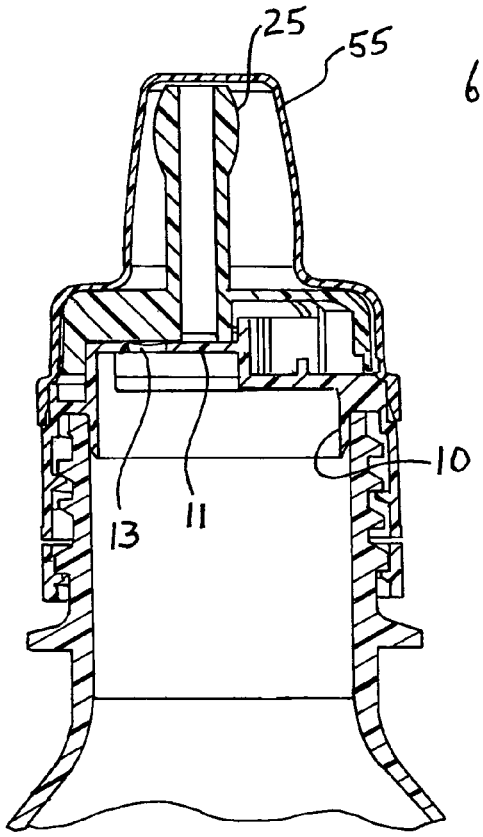
FIG. 6 is a cross-sectional view of the closure device of FIGS. 1 to 5 in a closed configuration.

In use of the closure device according to the present invention, the closure device will generally be purchased by a user as part of a drink container in the form shown in FIG. 6. The user will remove the cover 51, either completely or by pivoting the upper part of the cover away from the remainder with the hinge 61, to expose the outlet 25. The user can then move the top 23 relative to the base 1 in the direction of the arrow 47, for example with a thumb. Movement of the top in the direction of the arrow causes the free ends of the resilient members 43 to slide along the curved rear edge 21 of the raised surface 11 of the base 1 such that the free ends approach each other.

Figure 7:
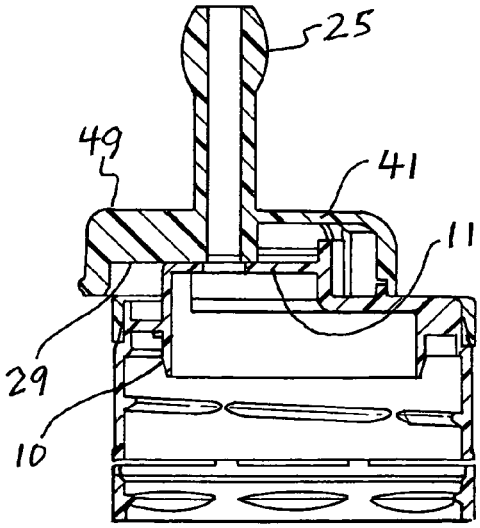
FIG. 7 is a cross-sectional view of the closure device of FIGS. 1 to 5 in an open configuration.

Movement of the top in the direction of the arrow 47 causes the apertures 13 and 27 to become aligned (as shown in FIG. 7) so that the user can withdraw liquid from the container either by sucking (where a straw is provided extending into the liquid) or by tilting the container such that liquid runs out of the outlet 25.

Flexing of the resilient members 43 stores energy in the resilient members which, when the movable top 23 is released by the user, urges the top towards its rest position (as shown in FIG. 6) in which the apertures 13 and 27 are not aligned and the closure device is sealed.

It should be noted that the raised surface 11 of the base 1 and the substantially planar surface 29 of the top 23 need not be planar. It will be clear to the skilled person that these two surfaces can have other configurations, such as curved about the axis of relative movement thereof, provided that the configurations of the two surfaces are complementary such that the two surfaces abut against each other and inhibit the leakage of liquid therebetween.

Thus the closure device according to the present invention is intuitive for the user to open and is self-closing to avoid leakage of contents. The closure device can be operated with one hand and is therefore particularly useful in situations where the user is unable to use both hands, such as when driving or in sporting situations, for example, running and cycling. There is no need for the user to touch the outlet, so the closure device is particularly hygienic to use. The frangible connections provide both a tamper-evident cap and a tamper-evident cover. Further, the hinge ensures that the cover cannot be separated from the cap and therefore reduces litter, while maintaining the outlet hygienic.

The closure device shown in FIGS. 8 to 14 is similar to that shown in FIGS. 1 to 7 and the same references are used to denote the same or similar parts.

Figure 8:
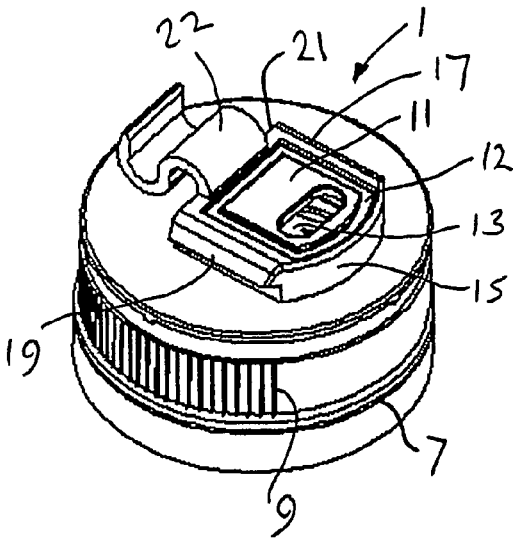
FIG. 8 is a perspective view from above of another embodiment of a base of a closure device according to the present invention.
Figure 9:
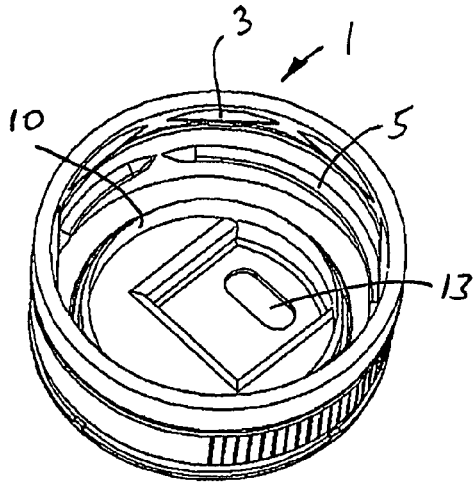
FIG. 9 is a perspective view from below of the base of a closure device shown in FIG. 8.

The closure device shown in FIGS. 8 to 14 includes a base 1 which is of generally cylindrical form and is adapted to be mounted on a bottle or like container by means of a screw thread 3, 5. The base 1 is shown most clearly in FIGS. 8 and 9. The base is ideally made of a plastics material. The screw thread 3, 5 is in two parts separated by a frangible connection 7. The frangible connection 7 enables the base 1 of the closure device according to the present invention to be used as a conventional bottle cap with the upper portion (as shown in FIG. 8) of the base 1 being separated from the lower portion by a relative twisting operation, allowing the upper portion of the base to be removed. The frangible connection 7 also serves as a tamper-evident seal. The twisting operation is facilitated by a serrated region 9 provided on the upper portion of the base 1.

A depending ring 10 is formed a predetermined distance radially within the outer skirt of the base 1. The construction of the closure device inhibits the use of a sealing washer and the depending ring fits closely within the container (not shown in FIGS. 8 and 9) to inhibit the escape of liquid between the container and the base 1.

Provided on a portion of the upper surface (as shown in FIG. 8) of the base 1 is a substantially planar raised surface 11 which includes a portion containing an outlet aperture 13 which is surrounded by a substantially rectangular recess 12. The aperture 13 may have any convenient shape, such as the elongate shaped shown in FIGS. 8 and 9.

The raised surface 11 has a curved front edge 15 located relatively close to an outer edge of the base 1, two opposing side edges 17, 19 and a plane rear edge 21 spaced a distance from the outer edge of the base. Because the front edge 15 is curved, a corresponding front edge of the rectangular recess 12 may also be curved. Thus the raised surface 11 is offset from the centre of the base 1 towards an outer edge thereof. The opposing side edges 17, 19 are formed with elongate protrusions extending along the upper (as shown in FIG. 8) portion of each side edge, which protrusions are spaced from the lower portion of each side edge.

A spring 22 is formed integrally with the rear edge 21 of the raised surface 11 and is in the form of a substantially horizontal wave, initially extending upwardly from the top of the rear edge 21 of the raised surface 21, and generally extends towards the periphery of the base 1. That is, when looked at laterally, the spring 22 looks like an "S" lying on its back.

The upper edge of the periphery of the base 1 may be serrated for reasons that will be explained in more detail hereinafter.

Although not shown in the drawings, the aperture 13 may be adapted to receive a tube, such as a flexible plastics tube, through which liquid may be drawn by the user in the manner of a straw.

Figure 10:
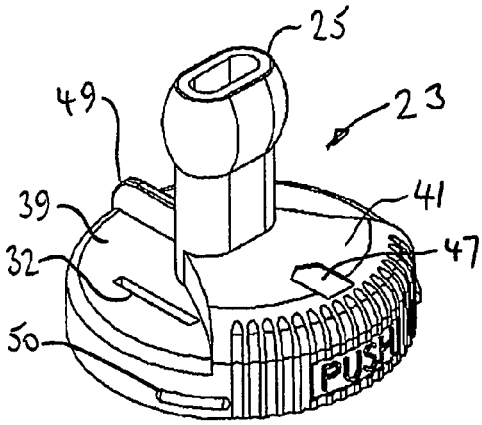
FIG. 10 is a perspective view from above of a top of another embodiment of a closure device according to the present invention.
Figure 11:
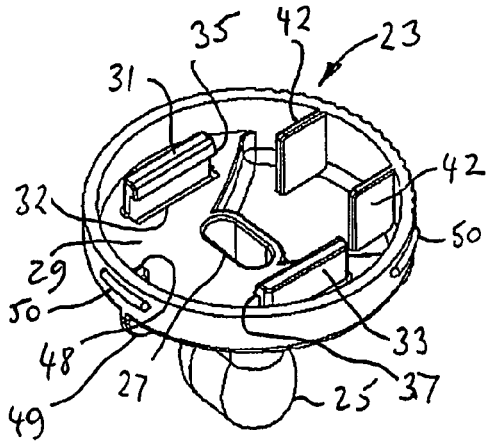
FIG. 11 is a perspective view from below of the top of the closure device shown in FIG. 10.

A top 23 is mounted on the base 1 in a manner which permits lateral sliding to occur between the base and the top. The top 23 is best shown in FIGS. 10 and 11. The top is also ideally made of a plastics material. More specifically, the top 23 is provided with an upwardly extending tubular outlet 25 which communicates with an aperture 27 which is of substantially the same shape as the aperture 13 in the base. The upper region of the tubular outlet 25 may be enlarged if desired. The aperture 27 is provided in a substantially planar surface 29 which is adapted to abut against the planar surface 11 of the base in a manner which substantially prevents the leakage of liquid between the two surfaces and which allows a relative sliding movement between the two surfaces. Sliding motion is controlled by a pair of downwardly extending linear webs 31, 33 which are formed on the facing surfaces thereof with elongate protrusions 35, 37 which extend towards one another. The linear webs 31, 33 extend substantially parallel to the opposing side edges 17, 19 of the base 1, while the protrusions 35, 37 of the top and the protrusions of the base co-operate such that the protrusions of the top are positioned between the protrusions of the base and the lower (as shown in FIG. 1) region of the side edges 17, 19 and such that the protrusions of the base are positioned between the protrusions of the top and an upper surface 39 of the top. In this way the co-operating protrusions allow relative sliding movement between the base and the top, but inhibit removal of the top from the base and thus prevent leakage of the closure device. Slits 32 are formed along that side of the webs 31 and 33 from which the protrusions 35, 37 extend so as to facilitate the manufacture of tooling to enable the top 23 to be made by injection moulding.

As with the embodiment of FIGS. 1 to 7, a number of protruding portions 50 extend around the periphery of the top 23.

A region 41 of the upper surface 39, generally in the form of a sector, is raised relative to the remainder of the upper surface of the top 23 and houses a pair of linear webs 42 which extend in a direction parallel to a diameter of the top 23 and therefore parallel to each other. An arrow 47 is provided on the upper surface 39 of the top to indicate the direction of movement of the top relative to the base and this may be emphasised by the word PUSH moulded into a side of the top 23. A stop 48 serves to limit movement of the top 23 in the opposite direction to the direction of the arrow 47, the stop 48 engaging against the curved front edge 15 of the raised surface of the base 1.

The apertures 13 and 27 are positioned in their respective planar surfaces in such a manner that they coincide only when the top has been moved in the direction of the arrow 47. In the illustrated embodiment, the aperture 27 of the top 23 is positioned substantially centrally of the base, while the aperture 13 of the base is offset towards the periphery thereof. The spring 22 of the base 1 extends towards and engages with the internal periphery of the top 23 between the walls 42, the walls 42 serving to maintain the wave-shaped spring in the desired orientation.

An upstanding web 49 is formed on the upper surface of the top on that side of the outlet 25 remote from the raised region 41. The purpose of the upstanding web 49 will be explained in more detail hereinafter.

Figure 12:
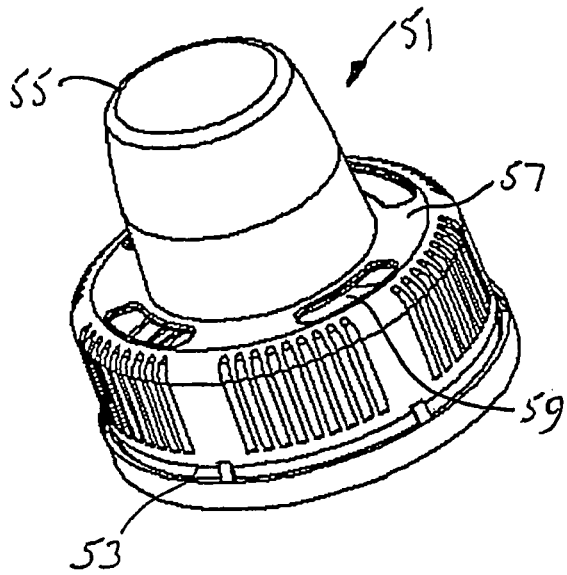
FIG. 12 is a perspective view from above of a cover of another embodiment of a closure device according to the present invention.

A cover 51, also of plastics (ideally transparent or translucent) material is mounted around the periphery of the base 1 by way of the serrations formed around the upper edge of the periphery of the base. The cover 51 is best shown in FIG. 12. The cover 51 is formed as two portions separated by a frangible connection 53. The frangible connection 53 allows the user access to the outlet 25 when the upper part of the cover is removed, but additionally serves as a tamper-evident seal. The upper part of the cover 51 is formed with a domed portion 55 which is joined to the remainder of the upper part by way of a shoulder region 57. A plurality of apertures 59 are formed around the shoulder region 57 to minimise the risk of choking in the unlikely event that a user should swallow the upper part of the cover 51. Once the frangible connection 53 has been broken, the upper part of the cap 51 can be retained on the top 23 by engagement with the peripheral protruding portions 50.

The upstanding web 49 formed on the upper surface of the top 23 engages against the underside of the shoulder region 57 together with the upper surface of the raised region 41 so as to provide support for the cover 51 in the event that the containers provided with the closure device are stacked on top of each other.

Although not shown, if desired the upper part of the cover 51 may be attached to the remainder thereof by way of a hinge. The hinge may be joined to the cover by way of arms which are of a sufficient length to allow the top to be moved away from the user's mouth so as to avoid obstructing use of the drink or like container.

Figure 13:
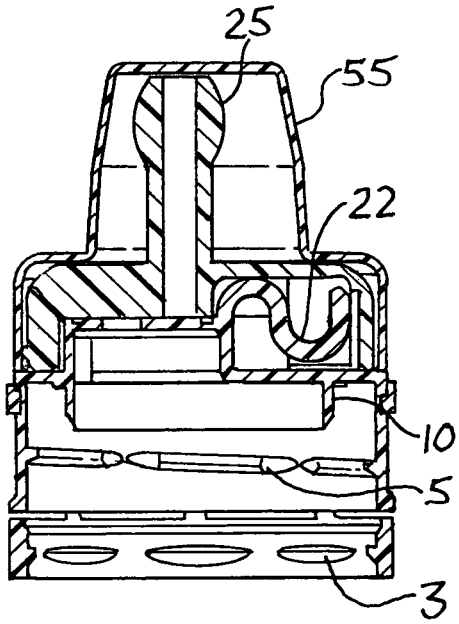
FIG. 13 is a cross-sectional view of the closure device of FIGS. 8 to 12 in a closed configuration.
Figure 14:
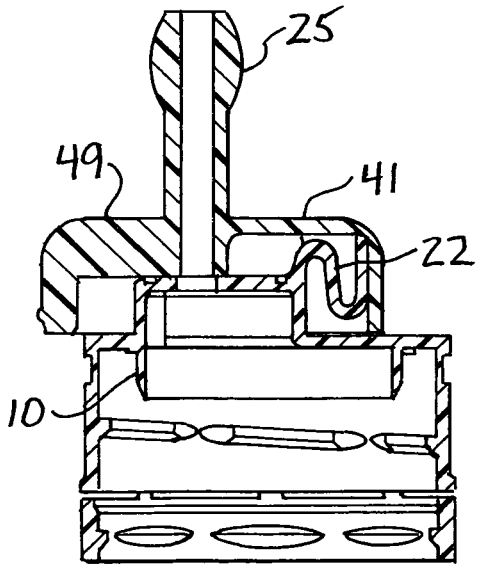
FIG. 14 is a cross-sectional view of the closure device of FIGS. 8 to 12 in an open configuration.

In use of the closure device shown in FIGS. 7 to 14, as with the closure device of the first embodiment the closure device will generally be purchased by a user as part of a drink container. The user will remove the cover 51 to expose the outlet 25. The user can then move the top 23 relative to the base 1 in the direction of the arrow 47, for example with a thumb. Movement of the top in the direction of the arrow causes the spring 22 to be compressed (as shown in FIG. 14) and therefore to store energy.

Movement of the top in the direction of the arrow 47 causes the apertures 13 and 27 to become aligned (as shown in FIG. 14) so that the user can withdraw liquid from the container either by sucking (where a straw is provided extending into the liquid) or by tilting the container such that liquid runs out of the outlet 25.

When the movable top 23 is released by the user, the energy stored in the spring 22 urges the top towards its rest position (as shown in FIG. 13) in which the apertures 13 and 27 are not aligned and the closure device is sealed.

As a further alternative, the top may be movable in a circular manner relative to the base with a spring serving as biasing means to return the top to its rest position with the apertures closed.

The invention claimed is:

1. A closure device comprising:

a base (1) having an aperture (13) arranged within a surface of predetermined configuration;

a top (23) having an aperture (27) arranged within a surface of complementary configuration to the surface of the base, the surface of the top being positioned adjacent to the surface of the base so as to inhibit the passage of material between the two surfaces;

the arrangement being such that the top (23) is adapted to be movable substantially laterally relative to the base (1) between a first position in which the aperture (13) of the base and the aperture (27) of the top are not in alignment and a second position in which the apertures are in alignment, and biasing means (22, 43) provided within the top so as to extend substantially laterally between the base and the top with a free end of the biasing means urging the top towards the first position in which the apertures (13, 27) are not in alignment, the biasing means (22) including a resilient member extending substantially radially outwardly from the base (1) towards the top (23), the top (23) being provided with inwardly extending webs (42) to restrict lateral movement of the biasing means (22).

2. A device as claimed in claim 1, wherein a single resilient member (22) is provided.

3. A device as claimed in claim 1, wherein the biasing means (22) is in the form of a wave.

4. A device as claimed in claim 3, wherein the biasing means (22) is in the form of a substantially horizontal wave.

5. A closure device comprising:

a base (1) having an aperture (13) arranged within a surface of predetermined configuration;

a top (23) having an aperture (27) arranged within a surface of complementary configuration to the surface of the base, the surface of the top being positioned adjacent to the surface of the base so as to inhibit the passage of material between the two surfaces;

the arrangement being such that the top (23) is adapted to be movable substantially laterally relative to the base (1) between a first position in which the aperture (13) of the base and the aperture (27) of the top are not in alignment and a second position in which the apertures are in alignment, and biasing means (22, 43) provided within the top so as to extend substantially laterally between the base and the top with a free end of the biasing means urging the top towards the first position in which the apertures (13, 27) are not in alignment, the biasing means (22, 43) being accommodated within a region (41) of the top which is raised relative to the remainder thereof.

6. A device as claimed in claim 5, wherein an upstanding web (49) is provided in part of the remainder of the top (23), the web extending to substantially the same height as the raised region.

* * * * *